US005310334A

United States Patent [19]

Spiros

[11] Patent Number: 5,310,334

[45] Date of Patent: May 10, 1994

[54] METHOD AND APPARATUS FOR THERMAL DESTRUCTION OF WASTE

[75] Inventor: Spiro Spiros, Mascot, Australia

[73] Assignee: Air Duke Australia, Ltd., Sydney, Australia

[21] Appl. No.: 892,754

[22] Filed: Jun. 3, 1992

[51] Int. Cl.[5] ..... F23D 14/00

[52] U.S. Cl. ..... 431/5; 431/198; 431/264; 423/210; 110/215; 110/216; 110/344

[58] Field of Search ..... 431/5, 12, 198, 258, 431/264, 278, 285; 110/210, 211, 212, 214; 432/72; 422/183, 168, 182; 423/210

[56] References Cited

U.S. PATENT DOCUMENTS 4,145,979 3/1979 Lilley et al. ..... 432/72 X
4,421,474 12/1983 Meyer ..... 431/115
4,481,889 11/1984 Sikander et al. ..... 110/211 X
4,680,008 7/1987 Rioux ..... 110/211 X
5,123,836 6/1992 Yoneda et al. ..... 110/215
5,169,605 12/1992 Carpentier ..... 110/214

*Primary Examiner*—Larry Jones
*Attorney, Agent, or Firm*—James E. Brunton

[57] ABSTRACT

An apparatus for removing contaminates from industrial waste streams by thermal destruction in which contaminated waste emission gases are controllably intermixed with hydroxy gas and the mixture thus formed ignited within a combustion chamber of unique design. The temperature within the combustion chamber is maintained at no less than 3000 degrees Fahrenheit to achieve molecular disassociation of the pollutants contained within the emission gas into harmless compounds.

16 Claims, 3 Drawing Sheets 2
34
32
28
14
75
92b
50
53
90
92a
74
52
30
47
46
43
45
51
20
16
24
26
18
92
EXHAUST
44
42
12
40
H/O
MIXING
H SOURCE
O SOURCE FIG. 2
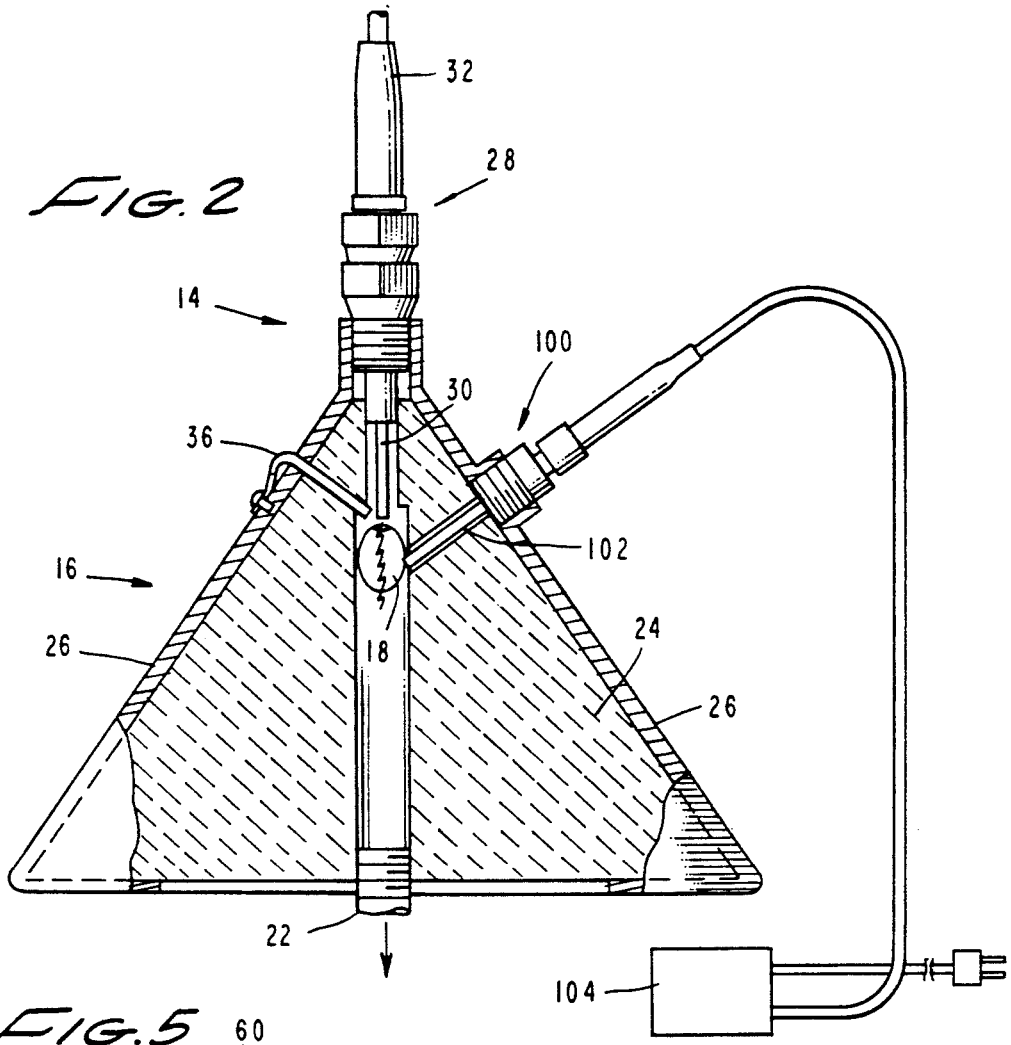
FIG. 5
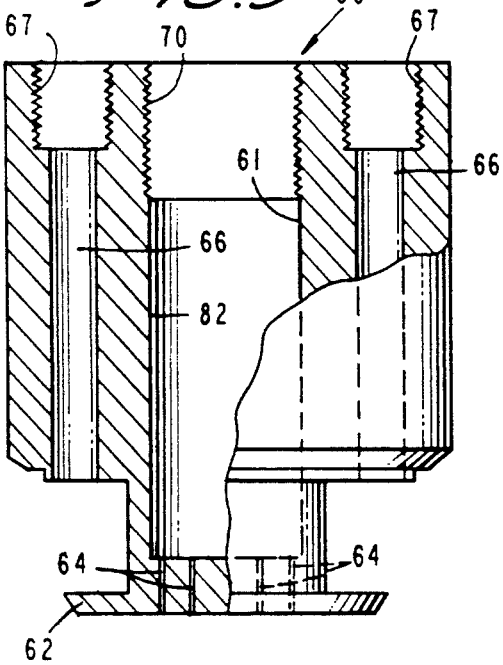
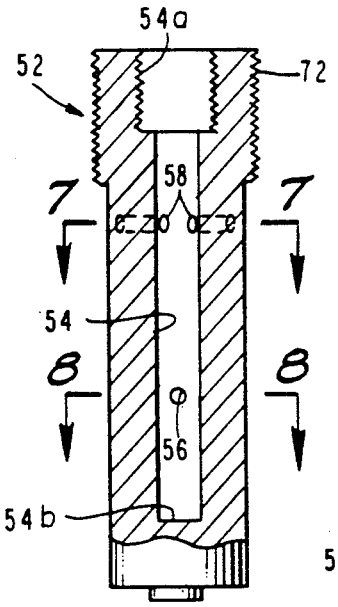
FIG. 6
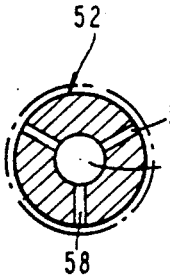
FIG. 7
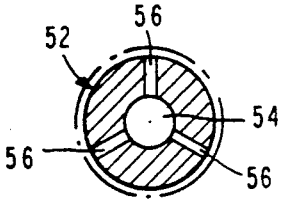
FIG. 8

METHOD AND APPARATUS FOR THERMAL DESTRUCTION OF WASTE

BACKGROUND OF THE INVENTION

1. Field of the Invention

The present invention relates generally to a method and apparatus for the thermal destruction of waste. More particularly, the invention concerns a novel afterburner apparatus and its method of use for removing pollutants from industrial waste streams by high temperature thermal destruction using hydroxy gas.

2. Discussion of the Invention

Industries throughout the world have come under increasing regulatory pressure to limit the quantities of pollutants discharged to the surrounding environments. Of particular concern is the removal from industrial waste streams of priority pollutants such as polyaromatic hydrocarbons (PAH), pesticides, heavy metals, volatile organic compounds (VOC), and PCB, to name but a few. The thrust of the present invention is to remove these priority pollutants from gaseous emissions by high temperature thermal destruction using hydroxy gas, that is, a gaseous mixture of hydrogen and oxygen.

While the use of hydroxy gas to accomplish high temperature burning is not new, the use of this gas in a closely controlled environment for the highly efficient thermal destruction of priority pollutants presents exciting, heretofore largely unexplored possibilities.

SUMMARY OF THE INVENTION

The apparatus of the present invention comprises a sealed combustion chamber having a unique configuration into which a precisely controlled mixture of hydroxy gas and the gaseous waste emissions to be thermally destroyed can be introduced. The gaseous mixture flows into the combustion chamber via an injector assembly of unique design which includes an injector element and a burner nozzle. After introduction of the gaseous mixture into the combustion chamber, it is controllably ignited in the absence of air by a novel arc type igniter assembly.

As discussed in detail in Australian Patent specification No. 71411/74 published Jan. 22, 1976, considerable energy is associated with the dissociation of molecular oxygen into atomic oxygen by passing this gas through an arc. As observed in the Australian patent, this property can be usefully employed to generate temperatures even higher than those previously attainable with, for example, an atomic hydrogen flame. The significance of the energy which can be obtained in this way can be appreciated from the following reactions that take place, and the heat energies associated therewith, when hydrogen and oxygen are both passed through an electric arc. Thus:

$$H_2 \longrightarrow H + H \text{ absorbing } 101{,}000 \text{ cal. per gram mole}$$

$$O_2 \longrightarrow O + O \text{ absorbing } 117{,}000 \text{ cal. per gram mole}$$

| | |
|---|---|
| total | 218,000 cal. per gram |

On recombination of these atoms this energy is released as heat through a number of complex chemical reactions and results in an extremely high flame temperature ideally suited for the safe and effective destruction of hazardous waste.

The injector assembly of the apparatus is water cooled to maintain the temperature inside the assembly below about 300° C., thus keeping the flame outside the nozzle and effectively preventing potential backflash.

The dimensions of the orifices provided in both the injector element and the burner nozzle are designed to optimum burning of the hydroxy gas within the combustion chamber of the apparatus. Additionally, the angle of the injection of the gas into the combustion chamber is precisely controlled so as to focus the concentration of the heat energy towards the center of the burner. Further, the residence time of the contaminates within the burner is optimized to effectively complete their destruction resulting in relatively rapid kinetics.

By changing direction of gas flow within the injector assembly at least four times, the hydrogen burns at very high velocity and combustion can be easily and safely terminated. Also, due to the absence of air inside the burner a unidirectional flow is maintained at all times during the combustion process.

With this summary description of the apparatus of the invention in mind, it is an object of the present invention to provide a method and apparatus for removing contaminates from industrial waste streams by thermal destruction in which contaminated waste emission gases are controllably intermixed with hydroxy gas and the mixture thus formed ignited in the absence of air within a combustion chamber of unique design.

Another object of the invention is to provide an apparatus of the aforementioned character in which the gaseous mixture is controllably introduced into the combustion chamber in a manner to optimize the safe and complete destruction of the contaminates.

Another object of the invention is to provide an apparatus as described in the preceding paragraph in which the injector assembly used to inject the gases into the combustion chamber is water cooled to prevent undesirable backflash.

Still another object of the invention is to provide an apparatus in which the injector assembly is uniquely designed to cause the gaseous mixture to flow along a tortuous path thereby insuring safe and effective termination of combustion at the end of the destruction cycle.

Another object of the invention is to provide an apparatus of the class described which is highly effective in accomplishing virtually complete destruction of pollutants such as polyaromatic hydrocarbons, heavy metals, volatile organics, pesticides and the like.

Yet another object of the invention is to provide an apparatus for thermal destruction of industrial waste contaminates which is both efficient and reliable in operation, is of simple design and can be economically constructed and operated.

BRIEF DESCRIPTION OF THE DRAWING

FIG. 2 is a cross-sectional view taken along lines 2—2 of FIG. 1.

FIG. 5 is a side elevational view partly in cross-section of the burner nozzle portion of the gas injector assembly.

FIG. 6 is a side elevational view partly in cross-section of the injector portion of the injector assembly.

FIG. 7 is a cross-sectional view taken along lines 7—7 of FIG. 6.

FIG. 8 is a cross-sectional view taken along lines 8—8 of FIG. 6.

DESCRIPTION OF THE INVENTION

Figure 1:
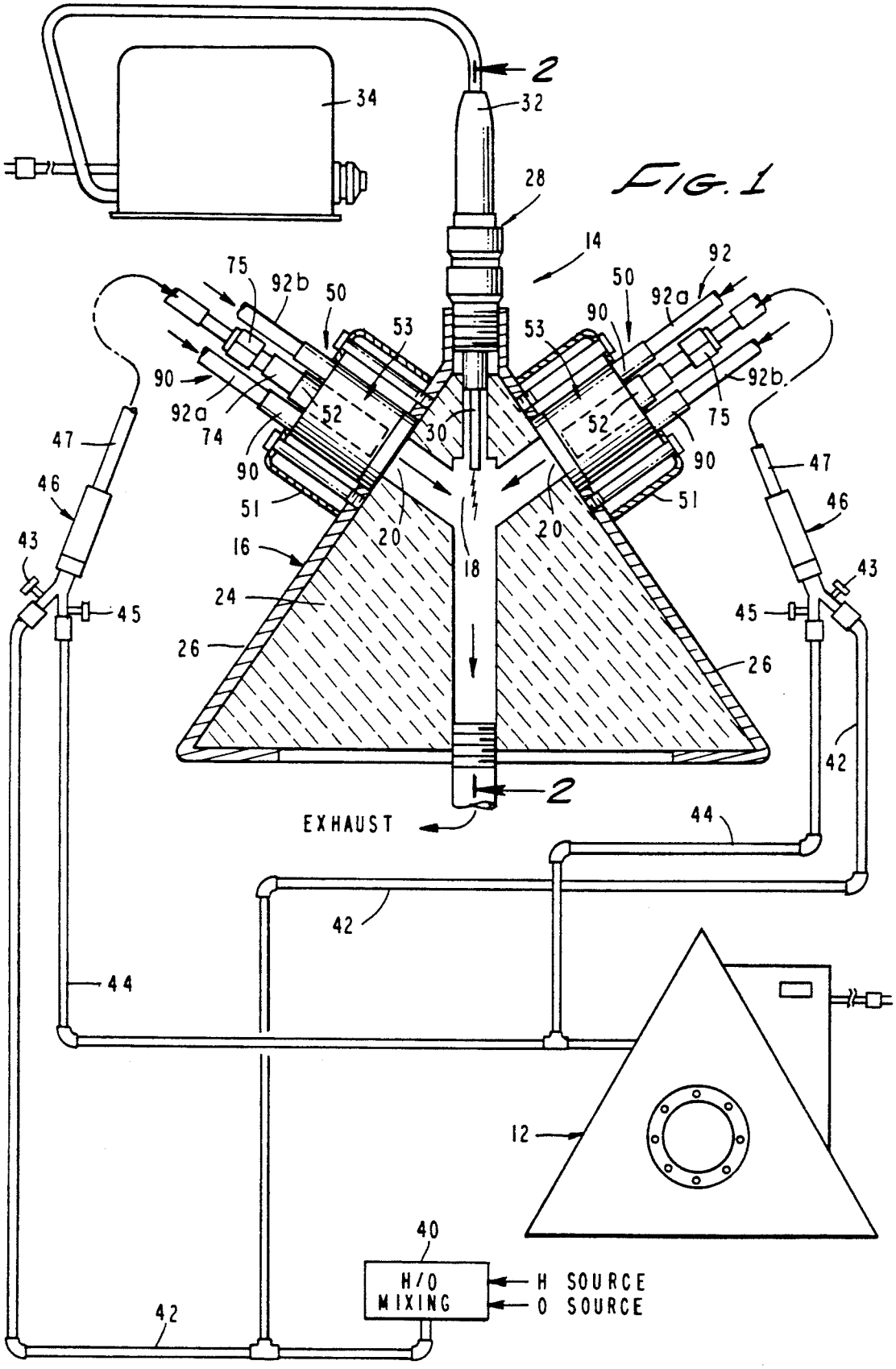
FIG. 1 is a generally schematic, side elevational view partly in cross-section of one form of the apparatus of the invention.

Referring to the drawings and particularly to FIGS. 1 and 2, the apparatus of one form of the invention for use in the thermal destruction of waste, is there illustrated. In this embodiment of the invention, the apparatus comprises a waste burning unit generally designated by the numeral 12 and an afterburner unit generally designated by the numeral 14. The afterburner unit functions to accomplish thermal destruction of waste materials contained within gaseous emissions emanating from the waste burning or incineration unit 12. Unit 12 is of standard construction and may be electrically heated or it may be heated by natural gas or the like.

The afterburner apparatus, which is a highly important feature of the invention, comprises a generally pyramidal-shaped housing 16 having an internal combustion chamber 18 which is sealed from atmosphere. Combustion chamber 18 is provided with a pair of inlet passageways 20 and an exhaust passageway 22. Disposed internally of housing 16 and surrounding combustion chamber 18 is a refractory material, such as a ceramic, generally designated by the numeral 24. The outer shall 26 of the housing is preferably constructed from a metal such as stainless steel.

Interconnected with housing 16 is an ignition means for controllably generating an electric arc within internal combustion chamber 18 in the absence of air. In the embodiment of the invention shown in the drawings, the ignition means includes a spark plug 28 having a central electrode 30 which extends into combustion chamber 18 and further includes a connector 32 for interconnecting the spark plug with a source of ignition voltage, shown here as an ignition transformer 34. Ignition transformer 34 is of standard construction and is readily commercially available from various commercial sources including Sur Lite Corporation of Sante Fe Springs, Calif. As best seen by referring to FIG. 2, a grounding electrode 36 is interconnected with shell 26 of the housing and has a free end extending into combustion chamber 18 in close proximity with central electrode 30 of the spark plug 28. Spark plugs suitable for use in the apparatus of the invention are commercially available from various sources including the Sur Lite Corporation. In operation, the ignition current coming from the transformer 34 flows through the central electrode and produces an arc between this electrode and the grounding electrode 36. The ignition voltage may vary depending upon end application, but it is normally on the order of approximately 25,000 volts. The spark gap between the ground and the central electrode can also vary depending upon end application but preferably is on the order of about 1/16th of an inch.

Also comprising part of the apparatus of the instant form of the invention is a source of hydrogen gas, a source of oxygen gas, and first mixing means for intermixing the hydrogen and oxygen gases to form a hydroxy gas. The first mixing means is shown in FIG. 1 as a hydrogen/oxygen mixing chamber 40 of a character well known in the art. Interconnected with mixing chamber 40 by a pair of conduits 42 is a second gas mixing means for intermixing the hydroxy gas produced in the mixing chamber 40 with the gaseous emissions emanating from roasting unit 12. These gaseous emissions are conducted toward the second gas mixing means of the invention by a pair of conduits 44. As best seen by referring to FIG. 1, the second gas mixing means of the embodiment of the invention there shown comprises a pair of mixing chambers 46 which are operably interconnected with conduits 42 and 44. Suitable valves 43 and 45 control the flow of gases from conduits 42 and 44 into mixing chambers 46.

Figure 3:
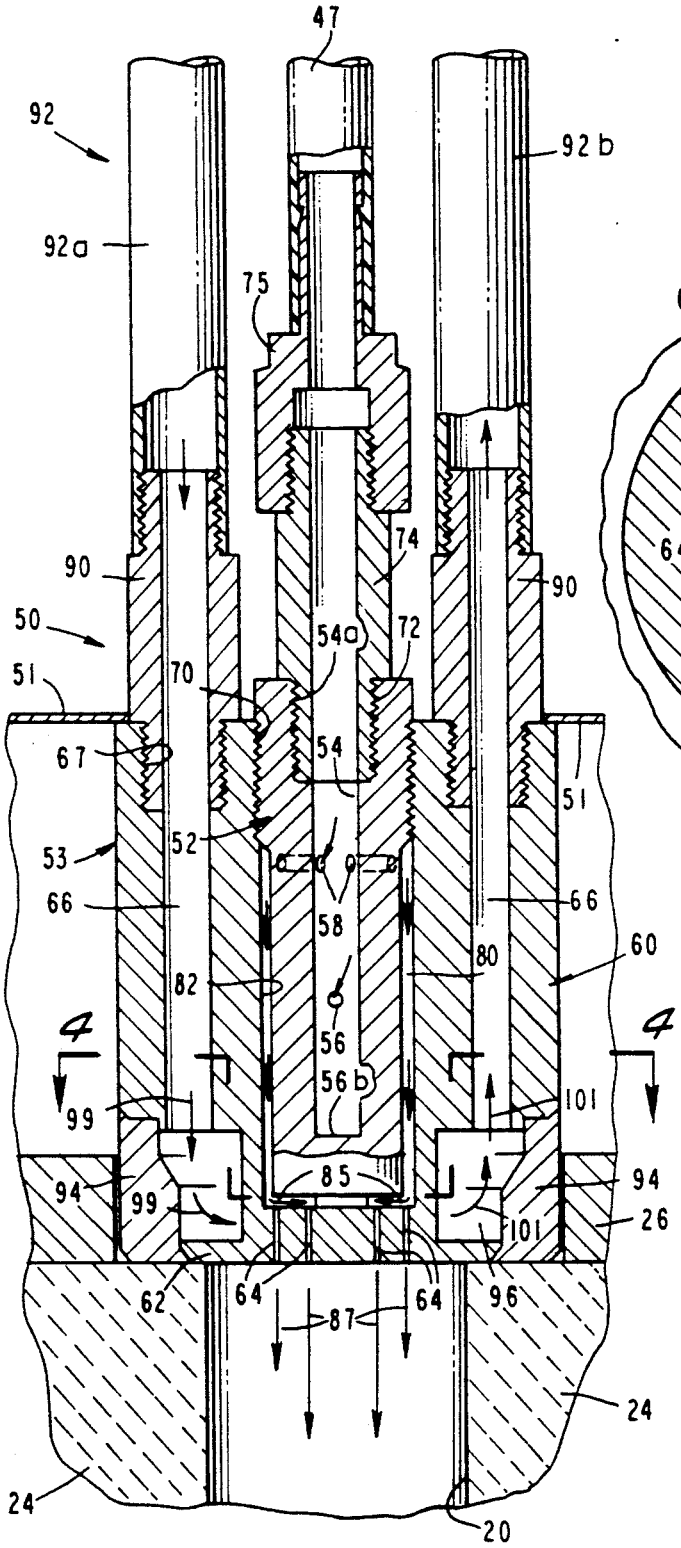
FIG. 3 is a greatly enlarged, cross-sectional view of the gas injector assembly of the apparatus of one form of the invention.

Each of the gas mixing chambers 46 is interconnected via a conduit 47 with a gas injector means, or injector assembly 50, which is interconnected with housing 16 by brackets 51 in the manner shown in FIG. 1 and 3. Turning also to FIGS. 5 and 6, the gas injector assembly of the present embodiment of the invention can be seen to comprise an injector element 52 (FIG. 6) and a burner nozzle 54 (FIG. 5). As best seen in FIG. 6, injector element 52 is provided with a central bore 54 and first and second sets of circumferentially spaced apart gas outlets 56 and 58. (See also FIGS. 7 and 8). Bore 54 is provided with an internally threaded enlarged diameter portion 54*a* and a closed end portion 54*b*. Sets of gas outlets 56 and 58 are longitudinally spaced apart from one another and are located intermediate ends 54*a* and 54*b* of bore 54.

Figure 4:
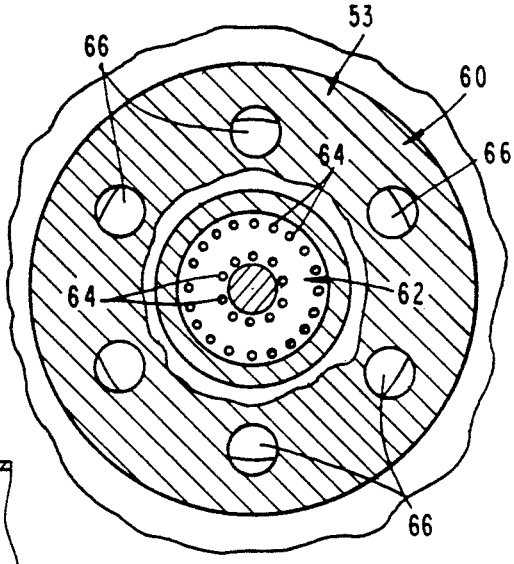
FIG. 4 is a cross-sectional view taken along lines 4—4 of FIG. 3.

Referring now to FIG. 5, burner nozzle 53 can be seen to include a generally tubular shaped skirt portion 60 and a flange portion 62. As best seen by referring also to FIG. 4, flange portion 62 is provided with a multiplicity of circumferentially spaced apart gas passageways 64. As indicated in FIG. 4 passageways 64 are disposed within concentric rings which surround the central, longitudinal axis of the burner nozzle. Skirt portion 60 of the burner nozzle is provided with a plurality of circumferentially spaced bores 66, the purpose of which will presently be described.

The outboard portion of the central bore 61 of the burner nozzle is provided with internal threads 70 which, as best seen in FIG. 3, are adapted to threadably receive external threads 72 provided on the outboard end of injector element 52. Receivable within an internally threaded bore 54*a* of the injector element is a connector nipple 74 (FIG. 3) which, along with connector 75, functions to interconnect a conduit 47 with the injector element 52. As indicated by the arrows in FIG. 3, gas flowing from mixing chamber 46, which is a controlled mixture of hydroxy gas and waste emission gas flowing from burner 12, enters bore 54 and then flows radially outwardly through gas passageways 58 and 56 and into an annular shaped passageway 80 which is provided between ejector elements 52 and the inner walls of the central bore 82 of the burner nozzle 53. The gases flowing through annular space 80 are then directed radially inwardly in the manner indicated by the arrows 85 in FIG. 3 and then outwardly through the multiplicity of circumferentially spaced apertures 64 provided in flange 62 of the burner nozzle. Due to the unique arrangement and configuration of passageway 64, the gases are focused toward the center of combustion chamber 18 in the manner indicated by the arrows 87 in FIG. 3. The gases entering the combustion chamber are then controllable ignited by the ignition means in a manner presently to be described.

Referring particularly to FIGS. 3 and 5, it is to be noted that each of the passageways 66 includes an enlarged diameter, internally threaded portion 67. Threadably receivable within threaded portion 67 are connector nipples 90 which function to interconnect fluid passageways 66 with a plurality of water carrying conduits 92. Conduits 92 carry cooling water toward and away from an annular shaped cooling ring 94 which is disposed between flange portion 62 and skirt portion 60 of the burner nozzle (FIG. 3). It is to be noted that cooling ring 94 is provided with a water conducting annular shaped passageway 96 which is in fluid communication with each of the fluid passageways 66. With this construction water flowing into the injector assembly through the conduit designated in FIG. 3 by the numeral 92*a* flows into the cooling ring 94 in the manner indicated by the arrows 99. The cooling water then flows outwardly of the cooling ring and into the conduit designated by the numeral 92*b* (arrows 101). As indicated in FIG. 4, skirt portion 60 of the burner nozzle is provided with six circumferentially spaced fluid passageways 66. Three of these passageways function as water inlet passageways and three function as water outlet passageways. With this construction about 200° F. cooling water is continually recirculated through the annular space 96 provided within the cooling ring at a flow rate of about 10 liters per minute, thereby functioning to precisely control the temperature of the combustible gases flowing through the annular shaped passageway 80 and outwardly through the passageways 64 provided in the flange portion of the burner nozzle. Precise control of the temperature of the gases within this inboard area is extremely critical so as to prevent dangerous and highly undesirable backflashing of the gases flowing through the burner nozzle.

To accurately measure the temperature within combustion chamber 18, sensor means, shown here in the form of a thermocouple assembly 100, is connected to housing 16. The thermocouple assembly 100 includes a sensor element 102 disposed within chamber 18 and temperature read-out means 104 for continuously monitoring the combustion chamber temperature. Thermocouple assembly 100 is of standard construction and is readily commercially available as, for example, from Wilcon Industries of South El Monte, Calif. Accordingly, the details of its construction and operation will not be described herein. Interconnected with the thermocouple are read-out means which can be a digital read-out system of the character sold by Eurotherm under the model designation 92. This system forms no part of the present invention and, therefore, will not be described herein.

In using the apparatus of the invention, the waste to be treated is burned within roasting unit 12 in a conventional manner. Gaseous fumes or emissions produced by the roasting of the waste are collected and introduced into conduits 44. These emissions typically will contain hydrocarbons emissions and other volatile pollutants which are to be processed within the afterburner unit 14.

The emissions emanating from the roasting unit are stoichiometrically mixed with the hydroxy gas which preferably comprises a mixture of about 66.66 percent hydrogen and 33.33 percent oxygen. This mixture flows from stoichiometric mixing chamber 40 into conduits 42 and thence to static mixing chamber 46 where it combines with the waste emissions. The hydroxy gas—gaseous emission mix will, of course, vary depending upon the character of the waste emissions. Accordingly, prior to mixing, the BTU content of the waste emissions is measured by a sampling process well known to those skilled in the art. Ideally the mixture of the hydroxy gas and the emissions gas is on a one-to-one heat of combustion basis. For example if the BTU valve of the emission gas to be treated is found to be 100 BTUs/liter at standard temperature and pressure, then the ideal mix would be ten parts of hydroxy gas (having a value of 10 BTUs/liter at STP) to one part of emission gases.

During the thermal destruction process the appropriate mixture of hydroxy gas and emission gas is introduced into the combustion chamber through the injector assemblies in the manner previously described herein. The combustion chamber, with its novel "Y" shaped configuration, is precisely sized to accomplish complete pyrolysis of the gas mixture and to control the detonation on start-up to prevent the flame from being compressed back into the flow passageways. Upon enter chamber 18 the gas mixture is efficiently ignited by the ignitor means to produce conbustion at very high temperatures in excess of 3000° F. by maintaining the temperature within the combustion chamber at no less than 3000° F. for about three to six seconds, sufficient energy is provided to accomplish molecular disassociation of all of the pollutants contained within the emission gases into harmless compounds that can be safely exhausted to atmosphere through exhaust 22. To insure that a sufficient temperature is maintained within the combustion chamber, chamber temperature is continuously monitored by the sensor means and gas flow rates are appropriately adjusted by the control means. Normally a flow rate of the gases on the order of 2000 liter/hr. will maintain the desired temperature.

At all times during the thermal destruction process, the previously described cooling ring function to maintain the temperature within the burner nozzles below 300° C. This effectively precludes dangerous backflash and also prevents undesirable burning within the gas injector assemblies.

As previously discussed, instant shut off of the apparatus is assured due to the fact that the novel flow path of gases through the injector assemblies abruptly changes directions four times. These direction changes effectively break the linear momentum of the hydroxy flame (which travels at about 3600 in./sec.) causing it to be self-extinguishing.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. An apparatus for thermal destruction of pollutants contained within gaseous emissions from waste material comprising:

(a) a housing having an internal combustion chamber, said chamber having an inlet and an outlet;

(b) a source of mixed hydrogen and oxygen gas;

(c) gas mixing means connected to said source of mixed hydrogen and oxygen and in communication with the gaseous emissions to be burned for mixing said gaseous emissions with said mixed hydrogen and oxygen to produce a gaseous mixture, said mixing means having an outlet;

(d) a gas injector assembly mounted on said housing, said gas injector assembly having an inlet in communication with said outlet of said gas mixing means and an outlet in communication with said inlet of said internal combustion chamber;

(e) ignition means connected to said housing for controllably generating an electrical spark within said internal combustion chamber; and (f) cooling means for controllably cooling said gas injector assembly.

2. An apparatus as defined in claim 1 in which said combustion chamber is generally "Y" shaped in cross-section and is surrounded by a refractory material.

3. An apparatus as defined in claim 1 in which said gas injector assembly comprises an injector and a burner nozzle and in which said cooling means comprises an annular shaped ring surrounding said burner nozzle, said ring having a water inlet and a water outlet.

4. An apparatus as defined in claim 1 in which said burner nozzle comprises:

(a) a body portion provided with a central bore and at least two circumferentially spaced bores; and (b) a flange portion integrally formed with said body portion, said flange having a multiplicity of gas passageways in communication with said central bore of said body portion.

5. An apparatus as defined in claim 4 in which said injector is mounted within said central bore of said body portion and includes a generally cylindrically shaped body having a skirt portion provided with a plurality of circumferentially spaced gas passageways in communication with said central bore of said body portion of said burner nozzle.

6. An apparatus as defined in claim 4 in which said cooling means comprises an annular shaped ring surrounding said burner nozzle, said ring having a water inlet and a water outlet and in which said circumferentially spaced bores of said body portion of said burner nozzle are in communication with said water inlet and said water outlet of said annular shaped ring.

7. An apparatus for thermal destruction of contaminates contained within combustion emissions from waste material comprising:

(a) a housing having an internal combustion chamber, said chamber having an inlet and an outlet;

(b) a source of mixed hydrogen and oxygen gas;

(c) gas mixing means connected to said source of mixed hydrogen and oxygen and in communication with the combustion emissions for mixing said emissions with said mixed hydrogen and oxygen to produce a gaseous mixture, said mixing means having an outlet;

(d) a gas injector assembly mounted on said housing, said gas injector assembly comprising:

(i) an injector element having an inlet in communication with said outlet of said gas mixing means and having a plurality of gas outlets; and (ii) a burner nozzle having a generally tubular shaped skirt portion adapted to receive said injector element and a flange portion provided with a plurality of gas passageways in communication with said gas outlets of said injector element and also in communication with said combustion chamber;

(e) ignition means connected to said housing for controllably generating an electrical spark within said internal combustion chamber; and (f) cooling means for controllably cooling said gas injector assembly, said cooling means comprising an annular shaped ring surrounding said burner nozzle, said ring having a water inlet and a water outlet.

8. An apparatus as defined in claim 7 in which said injector element is provided with a central bore defining a wall and in which said gas outlets extend through said wall at circumferentially spaced apart location.

9. An apparatus as defined in claim 8 in which said gas passageways in said flange portion of said burner nozzle are circumferentially spaced apart along concentric rings surrounding the center of said flange.

10. An apparatus as defined in claim 9 in which said skirt portion of said burner nozzle is provided with circumferentially spaced water inlet and water outlet passageways in communication respectively with said water inlet and said water outlet of said annular shaped ring.

11. An apparatus for treatment of waste materials comprising:

(a) a burner means for burning the waste materials to produce combustion emission gases, said burner means having an emission gas outlet;

(b) a housing having an internal combustion chamber, said chamber having an inlet and an outlet;

(c) a source of mixed hydrogen and oxygen gas;

(d) gas mixing means connected to said source of mixed hydrogen and oxygen and in communication with said emission gas outlet of said burner means for mixing said emissions with said mixed hydrogen and oxygen to produce a gaseous mixture, said mixing means having an outlet;

(e) a gas injector assembly mounted on said housing, said gas injector assembly having an inlet in communication with said outlet of said gas mixing means and an outlet in communication with said inlet of said internal combustion chamber;

(f) arc producing means connected to said housing for controllably generating an electrical arc within said internal combustion chamber; and (g) cooling means for controllably cooling said gas injector assembly, said cooling means comprising an annular shaped ring connected to said injector assembly, said ring having a water inlet and a water outlet.

12. An apparatus as defined in claim 11 in which said gas injector assembly comprises an injector and a burner nozzle, said burner nozzle comprising:

(a) a body portion provided with a central bore and at least two circumferentially spaced bores; and (b) a flange portion integrally formed with said body portion, said flange having a multiplicity of gas passageways in communication with said central bore of said body portion.

13. An apparatus as defined in claim 12 in which said injector is mounted within said central bore of said body portion and includes a generally cylindrically shaped body having a skirt portion provided with a plurality of circumferentially spaced gas passageways in communication with said central bore of said body portion of said burner nozzle.

14. A method for treating waste materials in an apparatus of the character having a combustion chamber, gas mixing means for mixing the waste material with hydrogen and oxygen gas, an injector means for injecting the mixture into the chamber and an electric arc ignition means for igniting a gaseous mixture within the chamber, the method comprising the steps of:

(a) burning the waste materials to produce gaseous emissions;

(b) mixing said gaseous emissions with a mixture of hydrogen and oxygen to produce a gaseous mixture; and (c) introducing said gaseous mixture into the combustion chamber via the injection means and igniting said gaseous mixture with the electrical arc of the ignition means to cause said gaseous mixture to burn at an elevated temperature in excess of 3,000 degrees Fahrenheit.

15. A method as defined in claim 14 in which said gaseous mixture is ignited by the electrical arc in the absence of air.

16. A method as defined in claim 15 in which the apparatus further includes means for cooling the gas injector means and in which the method comprises the further step of cooling the injector means during the step of burning said gaseous mixture.

* * * * *